US009380667B2

(12) United States Patent
Ido et al.

(10) Patent No.: US 9,380,667 B2
(45) Date of Patent: Jun. 28, 2016

(54) ILLUMINATION DEVICE AND ILLUMINATION FIXTURE

(71) Applicant: Panasonic Intellectual Property Management Co., Ltd., Osaka (JP)

(72) Inventors: Shigeru Ido, Osaka (JP); Hiroshi Kido, Osaka (JP); Akinori Hiramatu, Nara (JP); Takeshi Kamoi, Kyoto (JP); Katsushi Seki, Shiga (JP); Daisuke Yamahara, Osaka (JP); Daisuke Ueda, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/743,539

(22) Filed: Jun. 18, 2015

(65) Prior Publication Data

US 2016/0037593 A1 Feb. 4, 2016

(30) Foreign Application Priority Data

Jul. 29, 2014 (JP) ..... 2014-154158

(51) Int. Cl.
*H05B 37/02* (2006.01)
*H05B 33/08* (2006.01)

(52) U.S. Cl.
CPC ..... *H05B 33/083* (2013.01); *H05B 33/089* (2013.01); *H05B 33/0809* (2013.01); *H05B 37/02* (2013.01)

(58) Field of Classification Search
CPC ..... H05B 33/08; H05B 37/02
USPC ..... 315/185 R, 186, 193, 291, 294, 295, 307
See application file for complete search history.

(56) References Cited

U.S. PATENT DOCUMENTS

| | | | | |
|---|---|---|---|---|
| 5,598,068 | A * | 1/1997 | Shirai | H05B 33/0827 315/160 |
| 7,317,287 | B2 * | 1/2008 | Blumel | H05B 33/0827 315/185 R |
| 8,791,641 | B2 * | 7/2014 | van de Ven | H05B 33/0809 315/188 |
| 2012/0212143 | A1 * | 8/2012 | Esaki | H05B 33/089 315/192 |
| 2013/0026931 | A1 * | 1/2013 | Jong | H05B 33/0818 315/186 |
| 2013/0313983 | A1 * | 11/2013 | Radermacher | F21K 9/17 315/187 |

FOREIGN PATENT DOCUMENTS

| | | |
|---|---|---|
| JP | 2006-147933 A | 6/2006 |
| JP | 2011-181593 A | 9/2011 |
| JP | 2013-020929 A | 1/2013 |
| JP | 2013-037837 A | 2/2013 |
| JP | 2013-161937 A | 8/2013 |

* cited by examiner

*Primary Examiner* — Tung X Le
(74) *Attorney, Agent, or Firm* — Renner, Otto, Boisselle & Sklar, LLP

(57) ABSTRACT

An illumination device includes a main light source block having a plurality of main light sources and a plurality of current limiters, and an auxiliary light source block having an auxiliary light source and a constant-current unit. A series circuit of the auxiliary light source and the constant-current unit is electrically connected in parallel with the main light source block, between first and second output terminals of a rectifier. A smoothing capacitor is electrically connected in parallel with a specific main light source among the plurality of main light sources. The specific main light source and a corresponding current limiter are electrically connected in parallel with the series circuit of the auxiliary light source and the constant-current unit.

18 Claims, 12 Drawing Sheets

ILLUMINATION DEVICE AND ILLUMINATION FIXTURE

CROSS REFERENCE TO RELATED APPLICATIONS

This application claims the benefit and priority of Japanese Patent Application No. 2014-154158, filed on Jul. 29, 2014, the entire contents of which are incorporated herein by reference.

TECHNICAL FIELD

The present invention relates to an illumination device using a solid-state light-emitting element as a light source and an illumination fixture equipped with the illumination device.

BACKGROUND ART

A light-emitting diode lighting device disclosed in Japanese Patent Application Publication No. 2006-147933 (hereinafter referred to as "Document 1") is an example of the related art. This conventional device is provided with a rectification circuit, a light-emitting diode circuit, a current-limiting resistor element, and a lighting control circuit. The rectification circuit is configured to output a pulsating voltage obtained by full-wave rectification of an AC voltage input from a sine wave AC power supply with an effective value of 100 V. The light-emitting diode circuit is configured by connecting a plurality of light-emitting diodes in series in the same direction. In the light-emitting diode circuit, a plurality of light-emitting diodes is connected in series such that anodes and cathodes thereof are oriented toward a high-potential side and a ground side of the rectification circuit, respectively. Further, the light-emitting diode circuit is divided into a plurality of groups (first diode circuit to sixth diode circuit) by taking a predetermined number of consecutive light-emitting diodes, from among the plurality of light-emitting diodes, as a unit. The current-limiting resistor element is connected between the rectification circuit and light-emitting diode circuit and configured to limit a current flowing through the light-emitting diode circuit.

The lighting control circuit has first to fifth drive switch devices that are separately connected in series with the respective diode circuits. The lighting control circuit is configured to light up the first to sixth light-emitting diodes in a cascade manner by ON/OFF orderly switching the first to fifth drive switch devices according to an instantaneous value of the pulsating voltage output from the rectification circuit.

In the related art example disclosed in Document 1, lighting control of a plurality of light-emitting diodes connected in series can be efficiently performed with a simple circuit configuration by increasing or decreasing the number of lighted light-emitting diodes according to the instantaneous value of a pulsating voltage.

However, in the related art example disclosed in Document 1, since the quantity of light changes according to the increase or decrease in the number of the lighted light-emitting diodes, light blinking sometimes becomes a problem. Frequent changes in screen brightness are particularly undesirable in images captured with video cameras.

Meanwhile, the problems encountered when a smoothing capacitor is connected between output terminals of the rectification circuit and the pulsating voltage is smoothed thereby include the decrease in power factor caused by the increase in the stop period of the input current and an overlarge surge current flowing through the smoothing capacitor when the AC power supply is switched on.

SUMMARY OF THE INVENTION

The present invention has been created with the foregoing in view and it is an object thereof to balance a light output while eliminating drawbacks such as a decrease in power factor.

An illumination device in accordance with the present invention is provided with a rectifier, a main light source block, and an auxiliary light source block. The rectifier is configured to rectify a sine wave AC voltage and output a pulsating voltage from first and second output terminals. The main light source block has a plurality of main light sources and a plurality of current limiters. The plurality of main light sources is electrically connected in series between the first and second output terminals, each of which has an LED array in which a plurality of light-emitting diodes is electrically connected in series. The plurality of current limiters is individually and electrically connected in series with the plurality of main light sources so as to respectively intervene between the plurality of main light sources and one of the first and second output terminals of the rectifier. The plurality of current limiters is configured to respectively limit currents flowing through the plurality of main light sources. The auxiliary light source block has an auxiliary light source and a constant-current unit. The auxiliary light source has an LED array in which a plurality of light-emitting diodes is electrically connected in series. The constant-current unit is configured to adjust a current flowing through the LED array of the auxiliary light source to a constant current. A series circuit of the auxiliary light source and the constant-current unit is electrically connected in parallel with the main light source block, between the first and second output terminals of the rectifier. A smoothing capacitor is electrically connected in parallel with a specific main light source among the plurality of main light sources. The specific main light source and a corresponding current limiter are electrically connected in parallel with the series circuit of the auxiliary light source and the constant-current unit.

The illumination fixture in accordance with the present invention is equipped with the illumination device and a fixture main body that holds the illumination device.

Each effect of the illumination device and the illumination fixture makes it possible to balance the light output while eliminating drawbacks such as the decrease in power factor.

BRIEF DESCRIPTION OF THE DRAWINGS

The figures depict one or more implementations in accordance with the present teaching, by way of example only, not bay way of limitations. In the figure, like reference numerals refer to the same or similar elements where.

DETAILED DESCRIPTION

Embodiment 1

An illumination device in accordance with Embodiment 1 of the present invention will be explained in detail with reference to FIGS. 1 and 2.

Figure 1:
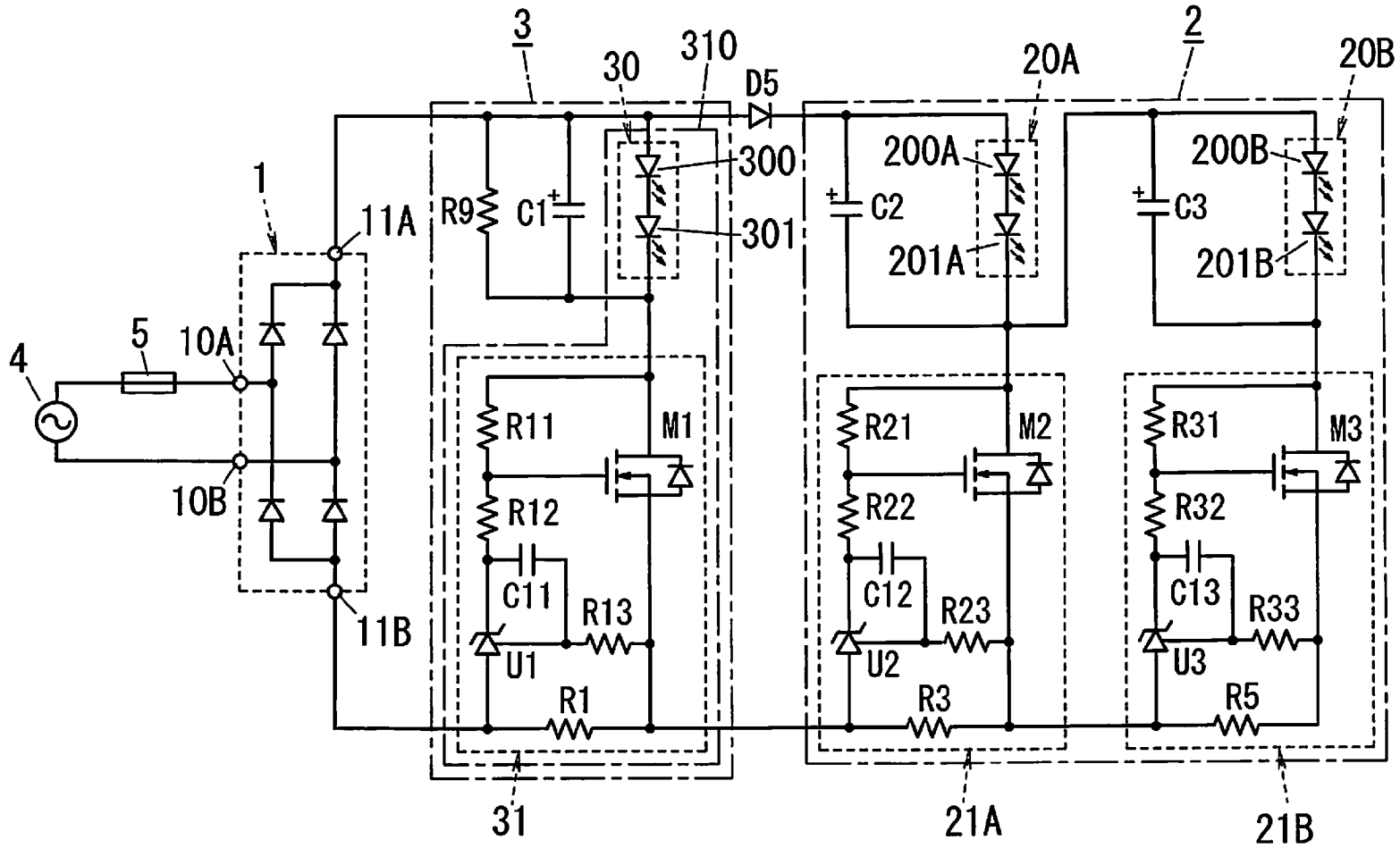
FIG. 1 is a circuit configuration diagram illustrating an illumination device in accordance with Embodiment 1 of the present invention.

As depicted in FIG. 1, the illumination device of the present embodiment has a rectifier 1, a main light source block 2, and an auxiliary light source block 3.

The rectifier 1 is constituted by a diode bridge and has first and second input terminals 10A, 10B and first and second output terminals 11A, 11B. An AC power supply 4 is electrically connected between the first and second input terminals 10A, 10B. A fuse 5 may be provided between the first input terminal 10A of the rectifier 1 and the AC power supply 4. In an example of FIG. 1, the first and second output terminals 11A, 11B are positive and negative output terminals, respectively.

For example, the AC power supply 4 supplies a sine wave AC voltage with an effective value of 100 V (volts). Therefore, a sine wave pulsating voltage with a maximum value (peak value) of $100\times\sqrt{2}\cong141$ V is output from between the first and second output terminals 11A, 11B of the rectifier 1. It is preferred that the rectifier 1 be configured such that the first output terminal 11A have a potential higher than that of the second output terminal 11B.

The main light source block 2 and the auxiliary light source block 3 are electrically connected in parallel with each other between the first and second output terminals 11A, 11B of the rectifier 1.

The main light source block 2 has a first main light source 20A and a second main light source 20B, a first current limiter 21A and a second current limiter 21B, and capacitors C2, C3. The first main light source 20A is formed of an LED array in which a plurality (two in the example depicted in the figure) of light-emitting diodes (LEDs) 200A, 201A is electrically connected in series. The LED array (first main light source 20A) is configured to emit light (be lit) by a current (electric current) flowing therethrough when potential of a positive electrode with respect to a negative electrode is equal to or higher than a reference voltage, where the positive electrode is an anode of the LED 200A and the negative electrode is a cathode of the LED 201A. The reference voltage is equal to a sum total of forward voltages of the LEDs 200A, 201A constituting the LED array. In the present embodiment, it is preferred that the reference voltage Vf1 of the first main light source 20A be set, for example, to 100 V. The capacitor C2 is a smoothing capacitor and electrically connected in parallel with the first main light source 20A.

The second main light source 20B is formed of an LED array in which a plurality (two in the example depicted in the figure) of LEDs 200B, 201B is electrically connected in series. The LED array (second main light source 20B) is configured to emit light (be lit) by a current flowing therethrough when potential of a positive electrode with respect to a negative electrode is equal to or higher than a reference voltage, where the positive electrode is an anode of the LED 200B and the negative electrode is a cathode of the LED 201B. The reference voltage is equal to a sum total of forward voltages of the LEDs 200B, 201B constituting the LED array. In the present embodiment, it is preferred that the reference voltage Vf2 of the second main light source 20B be set such that the sum total thereof with the reference voltage Vf1 of the first main light source 20A is equal to or lower than a maximum value of the pulsating voltage, for example, to 120 V. In other words, where the reference voltage Vf1 is 100 V, it is preferred that the reference voltage Vf2 be set to 20 V. The capacitor C3 is a surge suppressing capacitor and electrically connected in parallel with the second main light source 20B.

The first current limiter 21A is constituted by a constant-current circuit with a transistor M2 and a shunt regulator U2. The transistor M2 is constituted, for example, by an n-channel metal-oxide-semiconductor field-effect transistor (MOSFET), but may be also configured by an npn bipolar transistor.

A drain of the transistor M2 is electrically connected to the negative electrode (cathode of the LED 201A) of the first main light source 20A, and a source of the transistor M2 is electrically connected to a first end of a resistor R3 and a first end of a resistor R23. A gate of the transistor M2 is electrically connected to a connection point in a series circuit of two resistors R21, R22. A cathode of the shunt regulator U2 is electrically connected to a first end of the resistor R22 and a first end of a capacitor C12, and an anode of the shunt regulator U2 is electrically connected to a second end of the resistor R3. Further, a reference terminal of the shunt regulator U2 is electrically connected to a second end of the capacitor C12 and a second end of the resistor R23. The resistor R21 is electrically connected between the drain and the gate of the transistor M2. The resistor R21 serves for biasing the gate of the transistor M2. The resistors R22, R23 and the capacitor C12 constitute a filter circuit for setting a response characteristic of the shunt regulator U2.

The first current limiter 21A limits (adjusts to a constant current) a drain current of the transistor M2 by increasing or decreasing a cathode current (gate voltage) such as to match a voltage (voltage drop) generated across the resistor R3 with a reference voltage of the shunt regulator U2. The reference voltage of the shunt regulator U2 is, for example, 1.24 V. Where a resistance value of the resistor R3 is taken as 10Ω, the shunt regulator U2 controls the transistor M2 such that a current (=0.124 A) flows at which a voltage across the resistor R3 becomes 1.24 V.

In this case, since an output current (drain current of the transistor M2; same hereinbelow) easily becomes unstable under an effect of the capacitor C2, which is a capacitive load, the first current limiter 21A stabilizes the output current and suppresses oscillations by the abovementioned filter circuit. In the example of FIG. 1, the first current limiter 21A includes a first end electrically connected to the first main light source 20A, a second end electrically connected to a side of the second output terminal 11B of the rectifier 1, and a third terminal electrically connected to the second current limiter 21B. Specifically, in the first current limiter 21A, the first end corresponds to a connection point of the resistor 21 and the transistor M2, the second end corresponds to the anode of the shunt regulator U2, and the third end corresponds to the source of the transistor M2.

Similarly to the first current limiter 21A, the second current limiter 21B is constituted by a constant-current circuit with a transistor M3 and a shunt regulator U3. The second current limiter 21B is configured in the same way as the first current limiter 21A, except that the reference numerals, which are assigned to the elements, are different. Accordingly, detailed explanation relating to the second current limiter 21B is herein omitted.

A series circuit of the first main light source 20A and the first current limiter 21A is electrically connected between the first and second output terminals 11A, 11B of the rectifier 1. A series circuit of the second main light source 20B and the second current limiter 21B is electrically connected in parallel with the first current limiter 21A. Specifically, the series circuit of the second main light source 20B and the second current limiter 21B is electrically connected between the first and third ends of the first current limiter 21A.

The auxiliary light source block 3 has an auxiliary light source 30, a constant-current unit (constant-current circuit) 31, a capacitor C1, and a resistor R9. The auxiliary light source 30 is formed of an LED array in which a plurality (two in the example depicted in the figure) of LEDs 300, 301 is electrically connected in series. The LED array (auxiliary light source 30) is configured to emit light (be lit) by a current flowing therethrough when potential of a positive electrode with respect to a negative electrode is equal to or higher than a reference voltage, where the positive electrode is an anode of the LED 300 and the negative electrode is a cathode of the LED 301. The reference voltage is equal to a sum total of forward voltages of the LEDs 300, 301 constituting the LED array. In the present embodiment, it is preferred that the reference voltage Vf3 of the auxiliary light source 30 be set equal to or lower than half of the reference voltage Vf1 of the first main light source 20A, for example, to 50 V. The capacitor C1 is a smoothing capacitor and electrically connected in parallel with the auxiliary light source 30. The resistor R9 is electrically connected in parallel with each of the auxiliary light source 30 and the capacitor C1 and configured to discharge the capacitor C1 storing electric energy (charged energy).

When the electrostatic capacity of the capacitor C1 is relatively small, the resistor R9 may be omitted. However, where a wall switch equipped with a position display lamp is connected between the illumination device of the present embodiment and the AC power supply 4, the position display lamp is lit by a very small current flowing therethrough even when the wall switch is OFF. Accordingly, in order to prevent the auxiliary light source 30 from being lit by this very small current, it is desirable that the resistor R9 be electrically connected in parallel with the auxiliary light source 30. For example, in order to prevent the auxiliary light source 30 from being lit when a value of the very small current is 1 mA, it is desirable that the voltage drop on the resistor R9 be equal to or less than half of the reference voltage Vf3. Thus, the resistance value of the resistor R9 is preferably set equal to or less than (50 V/2)/1 mA=25 kΩ, for example, to 24 kΩ.

Similarly to the first current limiter 21A and the second current limiter 21B, the constant-current unit 31 is configured of a constant current circuit with a transistor M1 and a shunt regulator U1. The constant-current unit 31 is configured in the same way as the first current limiter 21A, except that the reference numerals, which are assigned to the elements, are different. Accordingly, detailed explanation relating to the constant-current unit 31 is herein omitted.

The auxiliary light source block 3 is electrically connected between the first and second output terminals 11A, 11B of the rectifier 1, and also electrically connected in parallel with the main light source block 2. A rectifying element (diode D5) is intervened, with a cathode thereof on the main light source block 2 side, between the main light source block 2 and the auxiliary light source block 3.

The diode D5 is provided to prevent electric energy (charged energy), which has accumulated in the capacitor C2, from discharging via a parasitic diode of the transistor M2. Thus, where a voltage between a source and a drain of the transistor M1 of the constant-current unit 31 is lower than a voltage across the capacitor C2, the energy accumulated in the capacitor C2 can discharge through the transistor M1, the resistor R3 and the parasitic diode of the transistor M2. For this reason, where a MOSFET is employed as the transistor M2, it is preferred that the diode D5 be provided along somewhere in the discharge path.

However, the first current limiter 21A, the second current limiter 21B, and the constant-current unit 31 operate while affecting each other. In other words, the output currents of the first current limiter 21A and the second current limiter 21B, rather than only the output current of the constant-current unit 31, flow through the resistor R1 of the constant-current unit 31. Thus, where an output current of the first current limiter 21A or the second current limiter 21B increases and the voltage across the resistor R1 rises, the output current of the constant-current unit 31 decreases. Where the voltage drop on (voltage across) the resistor R1 caused by the output current of the first current limiter 21A and the second current limiter 21B reaches the reference voltage of the shunt regulator U1, the constant-current unit 31 stops.

Likewise, the output current of the second current limiter 21B, rather than only the output current of the first current limiter 21A, flows through the resistor R3 of the first current limiter 21A. Thus, where the output current of the second current limiter 21B increases and the voltage across the resistor R3 rises, the output current of the first current limiter 21A decreases. Where the voltage drop on (voltage across) the resistor R3 caused by the output current of the second current limiter 21B reaches the reference voltage of the shunt regulator U2, the first current limiter 21A stops.

An operation of the illumination device in the present embodiment will be explained with reference to the circuit configuration diagram depicted in FIG. 1 and the waveform diagram depicted in FIG. 2. The operation explained hereinbelow takes place in one period of the output voltage (pulsating voltage) of the rectifier 1, that is, in half a period of the voltage of the AC power supply 4, and this operation is repeated each period of the pulsating voltage.

Figure 2:
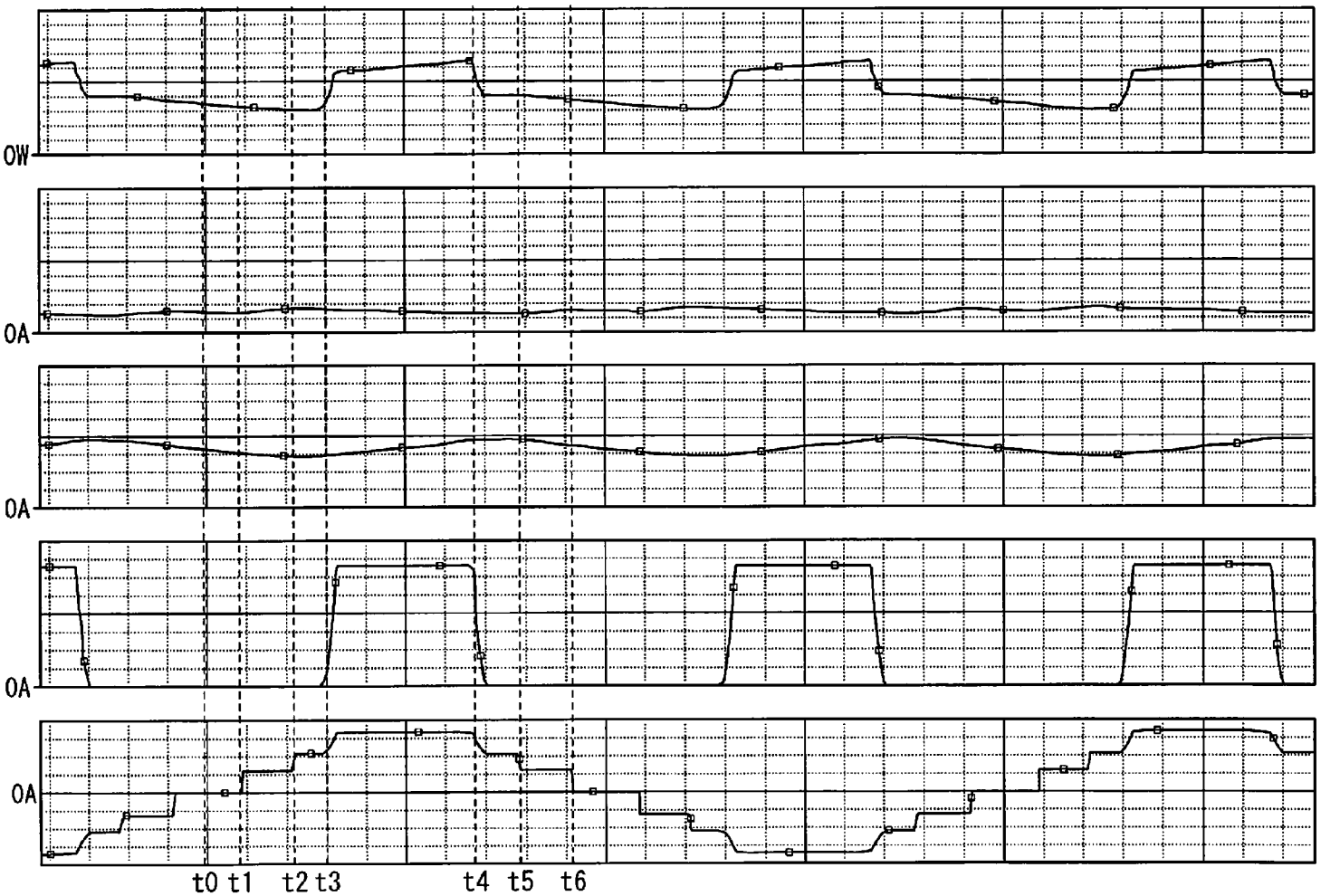
FIG. 2 is a waveform diagram illustrating an operation of the illumination device.

In FIG. 2, W0 denotes a sum total value of power consumed in the main light source block 2 and the auxiliary light source block 3, If3 denotes a current flowing through the auxiliary light source 30, If1 denotes a current flowing through the first main light source 20A, and If2 denotes a current flowing through the second main light source 20B. Further, Iin in FIG. 2 stands for an input current flowing from the AC power supply 4 to the first and second input terminals 10A, 10B of the rectifier 1.

A timing t=t0 is a zero cross point of the pulsating voltage (voltage of the AC power supply 4), and the output voltage (pulsating voltage) of the rectifier 1 at this timing is 0 V. In the vicinity of the zero cross point, the pulsating voltage is lower than the reference voltage Vf3 (=50 V) of the auxiliary light source 30, and therefore the input current Iin from the AC power supply 4 is 0 A. However, the first main light source 20A and the auxiliary light source 30 are lit by the electric currents If1, If3 caused by the discharge of electric energy (charged energy) of the capacitors C2 and C1, respectively.

Where the output voltage of the rectifier 1 rises and exceeds the reference voltage Vf3 (timing t=t1), the constant-current unit 31 operates and the auxiliary light source 30 is lit by the current If3 flowing therethrough. Therefore, the input current Iin flows in the illumination device from the AC power supply 4.

Where the output voltage of the rectifier 1 rises and exceeds the reference voltage Vf1 (=100 V) (timing t=t2), the first current limiter 21A operates and the first main light source 20A is lit by the current If1 flowing therethrough. The constant-current unit 31 is stopped by the currents If3 and If1 flowing through the resistor R1. However, the auxiliary light source 30 continues to be lit by the current If3 flowing therethrough caused by the discharge of the electric energy (charged energy) in the capacitor C1.

Where the output voltage of the rectifier 1 rises and exceeds the sum total of the reference voltages Vf1 and Vf2 (=120 V) (timing t=t3), the second current limiter 21B operates and the first main light source 20A and the second main light source 20B are lit by the currents If1 and If2 flowing therethrough, respectively. The first current limiter 21A and the constant-current unit 31 are stopped by the currents If1 and If2 flowing through each of the resistors R3 and R1.

Where, after reaching the maximum value, the output voltage of the rectifier 1 becomes less than the sum of the reference voltages Vf1 and Vf2 (timing t=t4), the second current limiter 21B stops and the first current limiter 21A operates. Where the second current limiter 21B stops, the current If2 continues to flow through the second main light source 20B as long as the electric energy (charged energy) in the capacitor C3 discharges. Where the first current limiter 21A operates, the first main light source 20A is lit by the current If1 flowing therethrough by the input current Iin from the AC power supply 4.

Where the output voltage of the rectifier 1 decreases and becomes less than the reference voltage Vf1 (timing t=t5), the first current limiter 21A stops and the constant-current unit 31 operates. Where the first current limiter 21A stops, the electric energy (charged energy) in the capacitor C2 discharges and the current If1 continuously flows through the first main light source 20A. Further, where the constant-current unit 31 operates, the auxiliary light source 30 is lit by the current If3 flowing therethrough by the input current Iin from the AC power supply 4.

Where the output voltage of the rectifier 1 further drops and becomes less than the reference voltage Vf3 (timing t=t6), the constant-current unit 31 stops. Where the constant-current unit 31 stops, the electric energy (charged energy) in the capacitor C1 discharges and the current If1 continuously flows through the first main light source 20A.

In the illumination device of the present embodiment, the smoothing capacitor C2 is electrically connected in parallel with the first main light source 20A. Because of the smoothing action of the capacitor C2, it is possible to light the first main light source 20A by allowing a current to flow therethrough even within the period of time in which the power supply voltage (output voltage of the rectifier 1) is lower than the reference voltage Vf1. Further, the auxiliary light source block 3 is electrically connected in parallel with the main light source block 2, and the input current Iin can be drawn into the auxiliary light source block 3 even within the period of time in which the power supply voltage (output voltage of the rectifier 1) is lower than the reference voltage Vf1. As a result, the power factor decrease can be suppressed. Further, in the period of time in which the power supply voltage (output voltage of the rectifier 1) is lower than the reference voltage Vf1, not only the first main light source 20A, but also the auxiliary light source 30 is lit. Therefore, the light output is balanced.

An outer dimensions of capacitors used for smoothing usually increase with the increase in capacity (electrostatic capacity) thereof. Therefore, in order to reduce the illumination device in size, it is preferred that a capacitor with as small a capacity as possible be used as the capacitor C2.

In order to efficiently suppress light ripples (fluctuations of quantity of light) of the first main light source 20A even with a small-capacity capacitor C2, it is preferred that a period of time in which the capacitor C2 is charged by a pulsating voltage be equal to a period time in which the capacitor C2 discharges.

The charge period and discharge period of the capacitor C2 are determined by a magnitude relationship between the reference voltage Vf1 of the first main light source 20A and an output voltage of the rectifier 1. For example, where the AC power supply 4 outputs a sine wave AC voltage with an effective value of 100 V, the pulsating voltage exceeds an effective value of the power supply voltage within a phase range of 45 degrees ($\pi/4$) to 135 degrees ($3\pi/4$). Therefore, where the reference voltage Vf1 of the first main light source 20A is set to 100 V, the charge period and discharge period of the capacitor C2 become equal to each other, and the light ripples of the first main light source 20A are suppressed most effectively.

Meanwhile, where the reference voltage Vf1 of the first main light source 20A is lower than 100 V, the light ripples of the first main light source 20A are increased, and an additional smoothing capacitor should be provided to reduce the light ripples.

Further, where the reference voltage Vf1 of the first main light source 20A is higher than 100 V, a lighting period of the first main light source 20A is shortened and a lights-out period of the first main light source 20A is extended. Therefore, the capacity of the capacitor C2 should be increased to balance the light.

Therefore, where the two above-described cases are compared, the latter case is preferred because the smoothing can be performed with one capacitor C2. Therefore, it is preferred that the reference voltage Vf1 of the first main light source 20A be set such that power is supplied from the rectifier 1 (AC power supply 4) within a phase range from 40 degrees to 60 degrees instead of 45 degrees.

However, where the reference voltage Vf1 of the first main light source 20A is set higher than 100 V, a period of time (stop period of time) in which the input current Iin does not flow is extended and the power factor decreases. By contrast, in the illumination device of the present embodiment, the auxiliary light source block 3 is electrically connected in parallel with the main light source block 2, between the first and second output terminals 11A, 11B of the rectifier 1. In other words, the current If3 flows through the auxiliary light source block 3 and the input current Iin is taken in within a period of time in which the pulsating voltage is below the reference voltage Vf1 of the first main light source 20A. Therefore, the power factor and input current distortions can be improved. Another merit is that a minimum value of light output within one period of the pulsating voltage is drawn up by lighting the auxiliary light source block 3.

The input current distortions can be further improved by using the configuration in which the auxiliary light source block 3 has a series circuit including two or more auxiliary light sources 30 and two or more constant-current units 31 and changing the number of the auxiliary light sources 30 which are to be lit, according to the pulsating voltage.

As described hereinabove, the illumination device of the present embodiment is provided with the rectifier 1, the main light source block 2, and the auxiliary light source block 3. The rectifier 1 is configured to rectify a sine wave AC voltage and output a pulsating voltage from the first and second output terminals 11A, 11B. The main light source block 2 has a plurality of main light sources (first main light source 20A and second main light source 20B) and a plurality of current limiters (first current limiter 21A and second current limiter 21B). The plurality of main light sources 20A, 20B is electrically connected in series between the first and second output terminals 11A and 11B, each of which has an LED array in which a plurality of light-emitting diodes 200A, 201A or 200B, 201B is electrically connected in series. The plurality of current limiters 21A, 21B is individually and electrically connected in series with the main light source 20A, 20B so as to respectively intervene between the plurality of main light sources 20A, 20B and one (11B) of the first and second output terminals 11A, 11B of the rectifier 1, and is configured to respectively limit currents flowing through the plurality of main light sources 20A, 20B. The auxiliary light source block 3 has the auxiliary light source 30 and the constant-current unit 31. The auxiliary light source 30 has the LED array in which the plurality of light-emitting diodes 300, 301 is electrically connected in series. The constant-current unit 31 is configured to adjust a current flowing through the LED array of the auxiliary light source 30 to a constant current. The series circuit 310 of the auxiliary light source 30 and the constant-current unit 31 is electrically connected in parallel with the main light source block 2, between the first and second output terminals 11A, 11B of the rectifier 1. The smoothing capacitor C2 is electrically connected in parallel with a specific main light source (first main light source 20A) among the plurality of main light sources 20A, 20B. The specific main light source 20A and a corresponding current limiter 21A are electrically connected in parallel with the series circuit 310 of the auxiliary light source 30 and the constant-current unit 31.

The illumination device of the present embodiment has the above-described configuration, and the light output thereof is balanced by the smoothing capacitor C2 which is electrically connected in parallel with the specific main light source 20A. Further, since the auxiliary light source block 3, which is electrically connected in parallel with the main light source block 2, draws in the input current Iin in the valleys of the pulsating voltage, the decrease in power factor can be suppressed. As a result, in the illumination device of the present embodiment, the light output can be balanced while eliminating drawbacks such as the decrease in power factor.

Embodiment 2

An illumination device in accordance with Embodiment 2 of the present invention will be explained with reference to FIGS. 3 and 4. The illumination device of the present embodiment has a basic configuration like Embodiment 1. Accordingly, constituent elements shared with the illumination device of Embodiment 1 are assigned with the same reference numerals and the explanation thereof is herein omitted.

The specific feature of the illumination device of the present embodiment is in configurations of a first light source 2A and an auxiliary light source 30.

Figure 3:
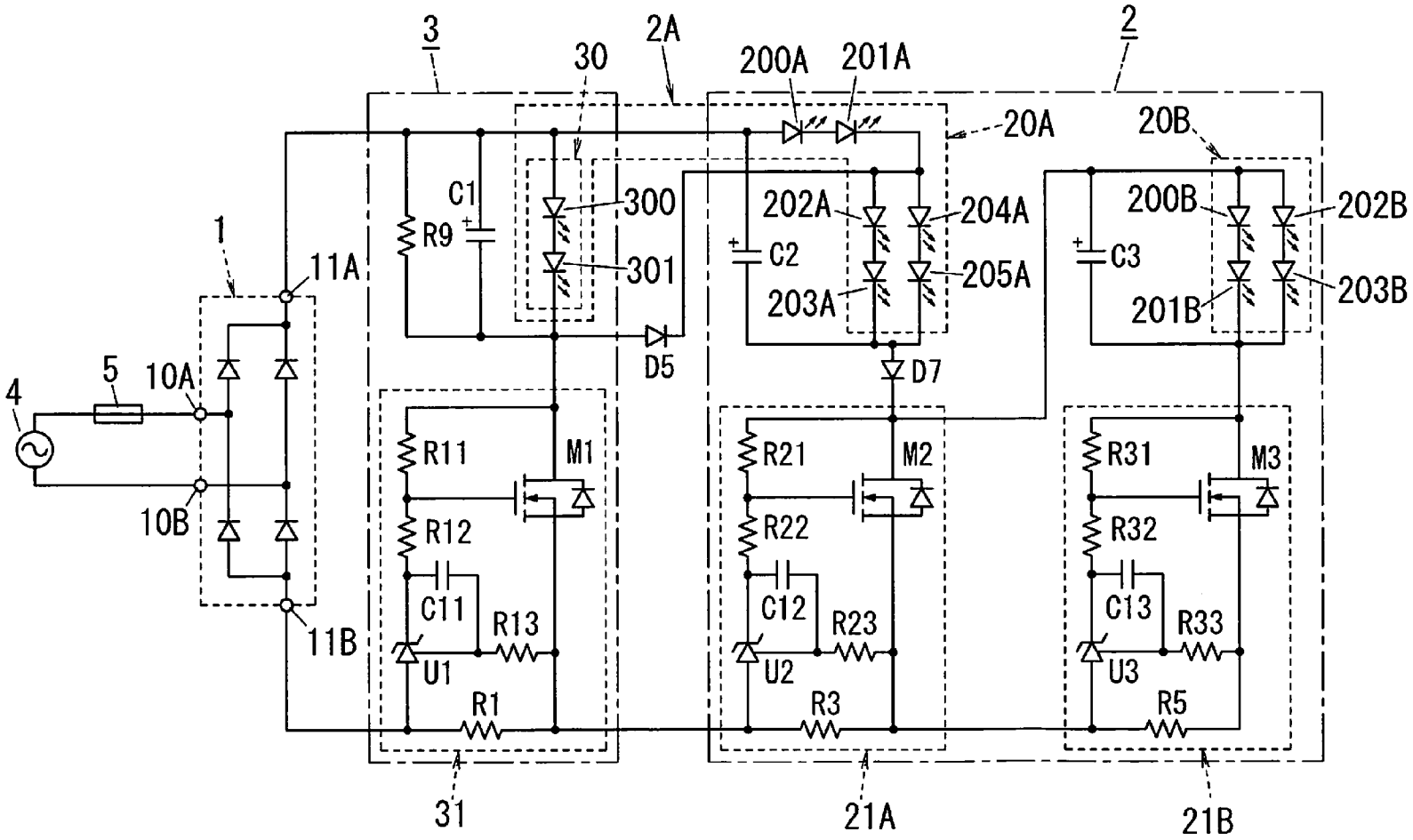
FIG. 3 is a circuit configuration diagram illustrating an illumination device in accordance with Embodiment 2 of the present invention.

As depicted in FIG. 3, the first light source 2A has a series-parallel circuit of four LEDs 202A, 203A, 204A, 205A in addition to a series circuit of two LEDs 200A, 201A (first LED array). The series-parallel circuit is constituted by a parallel circuit of a series circuit of two LEDs 202A, 203A (second LED array) and a series circuit of two LEDs 204A, 205A (third LED array). The first LED array and the parallel circuit of the second LED array and third LED array are electrically connected in series. Further, a capacitor C2 is electrically connected to a positive electrode of the first LED array (anode of the LED 200A) and negative electrodes of the second LED array and third LED array (cathodes of the LEDs 203A, 205A).

In the same manner as in Embodiment 1, the auxiliary light source 30 is formed of an LED array in which two LEDs 300, 301 are connected in series. However, a positive electrode of the auxiliary light source 30 is directly and electrically connected to the anode of the LED 200A, and a negative electrode of the auxiliary light source 30 is electrically connected to anodes of the two LEDs 202A, 204A through a diode D5.

Thus, in the illumination device of the present embodiment, the LED array (LEDs 300, 301) of the auxiliary light source 30 is electrically connected in parallel with the first LED array of a first main light source 20A and therefore functions as part of the first main light source 20A.

Further, a diode D7 is provided so as to prevent electric energy (charged energy) in the capacitor C2 from discharging through a transistor M1 when a constant-current unit 31 operates. The diode D7 is intervened, with an anode thereof being at the first main light source 20A side, between the first main light source 20A and a first current limiter 21A.

Next, an operation of the illumination device in the present embodiment will be explained with reference to the circuit configuration diagram depicted in FIG. 3 and a waveform diagram depicted in FIG. 4. The operation explained hereinbelow takes place in one period of an output voltage (pulsating voltage) of a rectifier 1, that is, in half a period of a voltage of an AC power supply 4, and this operation is repeated each period of the pulsating voltage.

Figure 4:
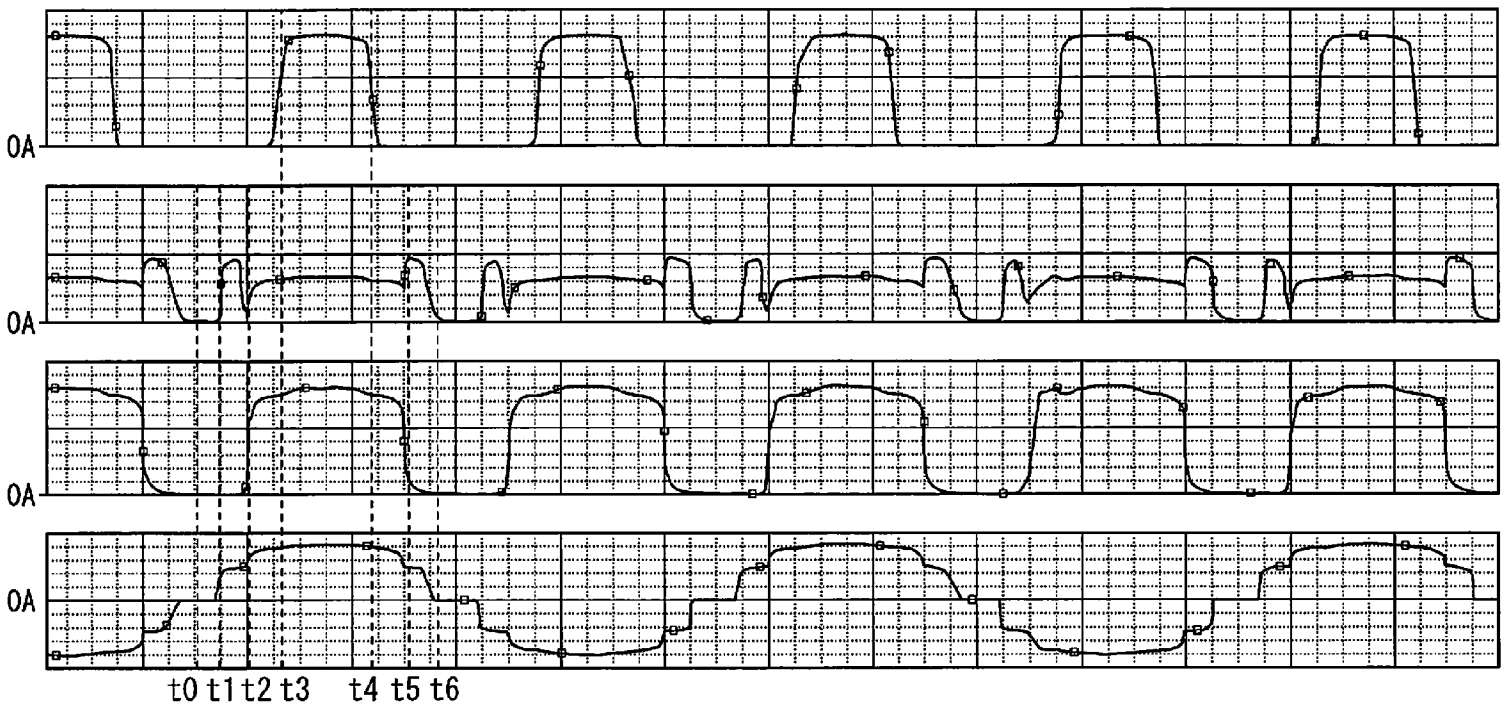
FIG. 4 is a waveform diagram illustrating an operation of embodiment 2.

In FIG. 4, If2 denotes a current flowing through a second main light source 20B, and If3 denotes a current flowing through the auxiliary light source 30. Further, $I_{D7}$ denotes a current flowing through the diode D7, that is, the sum total of an electric current If1 flowing through the first main light source 20A and an electric current flowing through the capacitor C2. Further, Iin stands for an input current flowing from the AC power supply 4 to input terminals 10A, 10B of the rectifier 1.

The timing t=t0 is a zero cross point of the pulsating voltage (voltage of the AC power supply 4), and the output voltage (pulsating voltage) of the rectifier 1 at this timing is 0 V. In the vicinity of the zero cross point, the pulsating voltage is lower than a reference voltage Vf3 (=50 V) of the auxiliary light source 30, and therefore the input current Iin from the AC power supply 4 is 0 A.

Where the output voltage of the rectifier 1 rises and exceeds the reference voltage Vf3 (timing t=t1), the constant-current unit 31 operates and the auxiliary light source 30 is lit by a current If3 flowing therethrough. Therefore, the input current Iin flows in the illumination device from the AC power supply 4.

Where the output voltage of the rectifier 1 rises and exceeds a reference voltage Vf1 (=100 V) (timing t=t2), the first current limiter 21A operates and the first main light source 20A is lit by the current If1 flowing therein. The constant-current unit 31 is stopped by currents If3 and If1 flowing through the resistor R1. However, since the current If3 flows through the diode D5 under the effect of the first current limiter 21A, the auxiliary light source 30 continues to be lit.

Where the output voltage of the rectifier 1 rises and exceeds the sum total of reference voltages Vf1 and Vf2 (=120 V) (timing t=t3), a second current limiter 21B operates and the first main light source 20A and the second main light source 20B are lit by currents If1 and If2 flowing therethrough, respectively. The first current limiter 21A and the constant-current unit 31 are stopped by the currents If1 and If2 flowing through each of the resistors R3 and R1.

Where, after reaching the maximum value, the output voltage of the rectifier 1 becomes less than the sum of the reference voltages Vf1 and Vf2 (timing t=t4), the second current limiter 21B stops and the first current limiter 21A operates. Where the second current limiter 21B stops, the current If2 continues to flow through the second main light source 20B as long as electric energy (charged energy) in a capacitor C3 discharges. Where the first current limiter 21A operates, the first main light source 20A and the auxiliary light source 30 are lit by the current $I_{D7}$ under the effect of the input current Iin from the AC power supply 4.

Where the output voltage of the rectifier 1 decreases and becomes less than the reference voltage Vf1 (timing t=t5), the first current limiter 21A stops and the constant-current unit 31 operates. Where the first current limiter 21A stops, the first main light source 20A is lit by the current If1 flowing therethrough while the electric energy (charged energy) in the capacitor C2 discharges. Further, where the constant-current unit 31 operates, the auxiliary light source 30 is lit by the current If3 flowing therethrough under the effect of the input current Iin from the AC power supply 4.

Where the output voltage of the rectifier 1 further drops and becomes less than the reference voltage Vf3 (timing t=t6), the constant-current unit 31 stops. Where the constant-current unit 31 stops, the first main light source 20A and the auxiliary light source 30 are lit by the current $I_{D7}$ flowing therethrough while the electric energy (charged energy) in the capacitor C1 discharges.

Thus, in the illumination device of the present embodiment, it is preferred that the LED array of the auxiliary light source 30 be configured by part of the LED array of the specific main light source (first main light source 20A). Where the illumination device of the present embodiment is configured in the above-described manner, the number of LED to be used in the main light source block 2 and the auxiliary light source block 3 can be reduced by comparison with the case in which the above-described configuration is not used.

Embodiment 3

Figure 5:
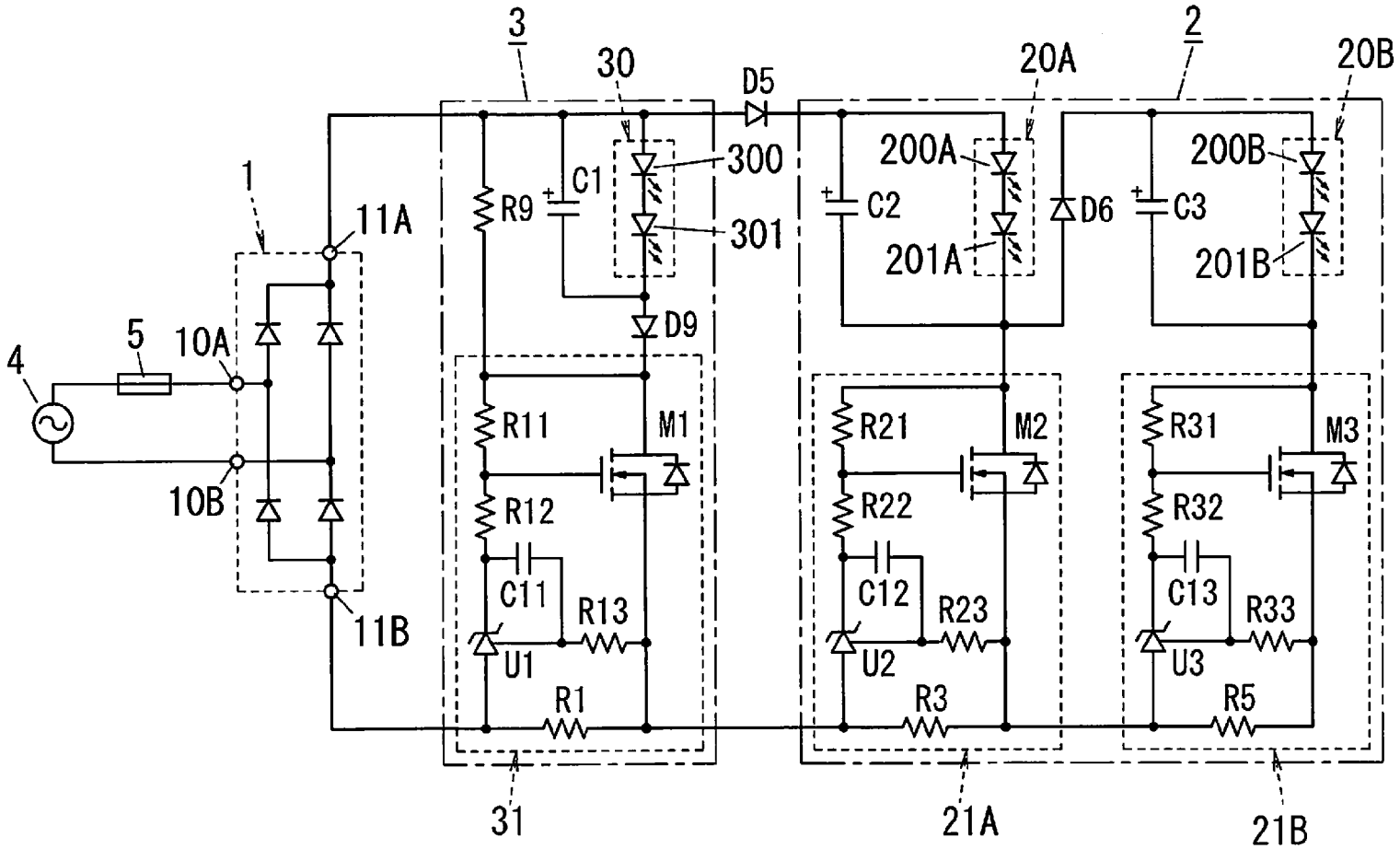
FIG. 5 is a circuit configuration diagram illustrating an illumination device in accordance with Embodiment 3 of the present invention.

An illumination device in accordance with Embodiment 3 of the present invention will be explained with reference to FIGS. 5 and 6. The illumination device of the present embodiment and the illumination device of Embodiment 1 share a basic configuration. Accordingly, constituent elements shared with the illumination device of Embodiment 1 are assigned with the same reference numerals and the explanation thereof is herein omitted.

A specific feature of the illumination device in the present embodiment is that a capacitor C3 which is electrically connected in parallel with a second main light source 20B is made a smoothing capacitor. More specifically, the capacity of the capacitor C3 is made larger than that of the capacitor C3 in Embodiment 1. Further, since a smoothing capacitor is used for the capacitor C3, a diode D6 is intervened between a first main light source 20A and the second main light source 20B. The diode D6 is intervened, with an anode thereof being on the first main light source 20A side, between the first main light source 20A and the second main light source 20B, and electric energy (charged energy) in the capacitor C3 is prevented from flowing in reverse toward the first main light source 20A.

Further, in the illumination device of the present embodiment, a diode D9 is intervened, with an anode thereof being on an auxiliary light source 30 side, between the auxiliary light source 30 and a constant-current unit 31. Further, a resistor R9 is electrically connected to a first output terminal 11A of the rectifier 1 and a cathode of the diode D9. The diode D9 is provided to prevent a discharge current of the capacitor C1 from flowing in reverse through a parasitic diode of the transistor M1.

An operation of the illumination device in the present embodiment will be explained with reference to the circuit configuration diagram depicted in FIG. 5 and a waveform diagram depicted in FIG. 6. The operation explained hereinbelow takes place in one period of the output voltage (pulsating voltage) of the rectifier 1, that is, in half a period of the voltage of the AC power supply 4, and this operation is repeated each period of the pulsating voltage.

Figure 6:
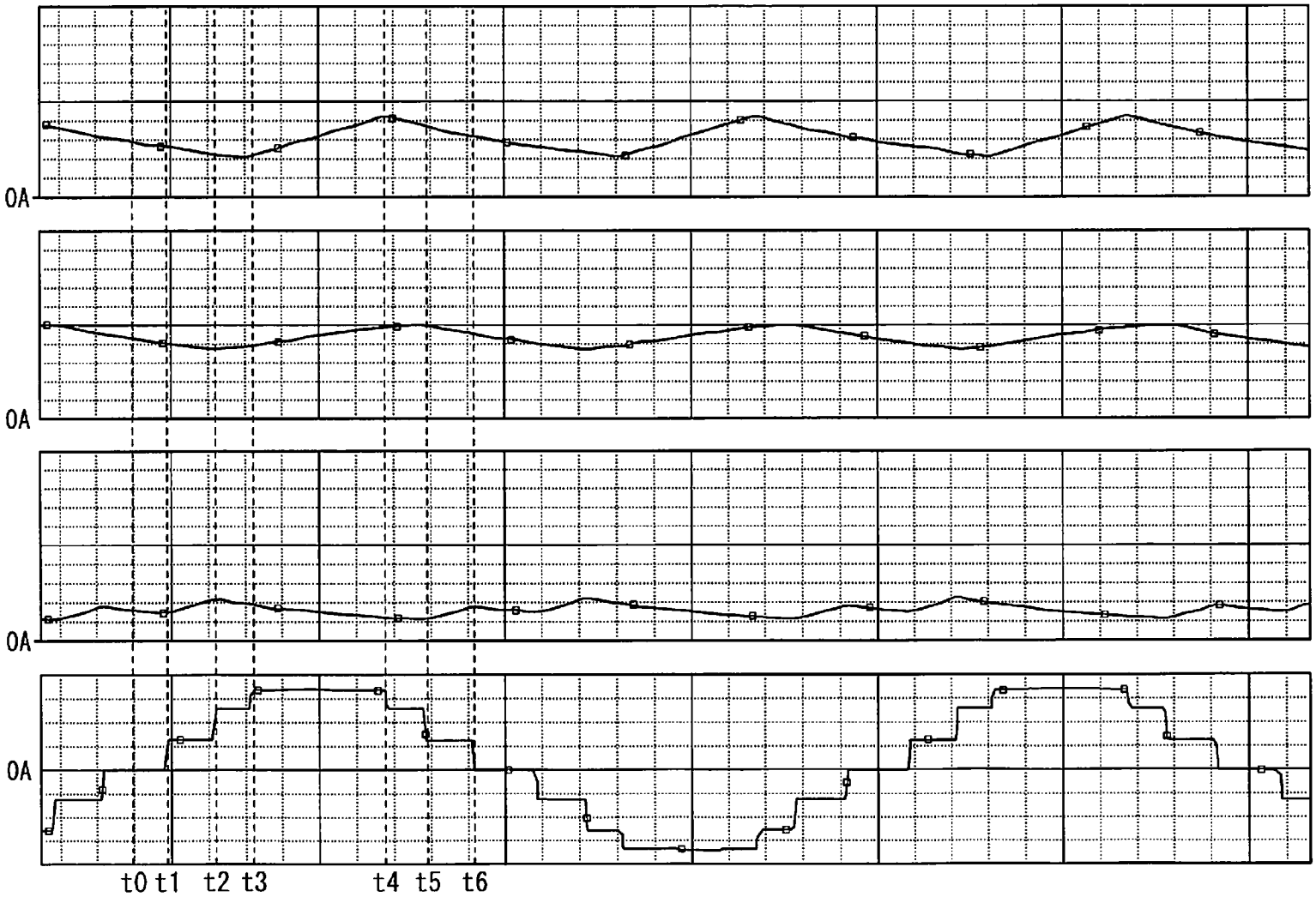
FIG. 6 is a waveform diagram illustrating an operation of Embodiment 3.

In FIG. 6, If2 denotes a current flowing through the second main light source 20B, If1 denotes a current flowing through the first main light source 20A, and If3 denotes a current flowing through the auxiliary light source 30. Further, Iin in FIG. 6 stands for an input current flowing from an AC power supply 4 to first and second input terminals 10A, 10B of the rectifier 1.

The timing t=t0 is a zero cross point of the pulsating voltage (voltage of the AC power supply 4), and the output voltage (pulsating voltage) of the rectifier 1 at this timing is 0 V. In the vicinity of the zero cross point, the pulsating voltage is lower than a reference voltage Vf3 (=50 V) of the auxiliary light source 30, and therefore an input current Iin from the AC power supply 4 is 0 A. However, the first main light source 20A, the second main light source 20B, and the auxiliary light source 30 are lit by the currents If1, If2, If3 flowing therethrough as a result of discharge of electric energy (charged energy) in the capacitors C2, C3, C1, respectively.

Where the output voltage of the rectifier 1 rises and exceeds a reference voltage Vf3 (timing t=t1), the constant-current unit 31 operates and the auxiliary light source 30 is lit by the current If3 flowing therethrough. Therefore, the input current Iin flows in the illumination device from the AC power supply 4.

Where the output voltage of the rectifier 1 rises and exceeds a reference voltage Vf1 (=100 V) (timing t=t2), a first current limiter 21A operates and the first main light source 20A is lit by the current If1 flowing therethrough. The constant-current unit 31 is stopped by the currents If3 and If1 flowing through the resistor R1. However, since the current If3 flows due to the discharge of the electric energy (charged energy) in the capacitor C1, the auxiliary light source 30 continues to be lit.

Where the output voltage of the rectifier 1 rises and exceeds the sum total of the reference voltages Vf1 and Vf2 (=120 V) (timing t=t3), a second current limiter 21B operates and the first main light source 20A and the second main light source 20B are lit by the currents If1 and If2 flowing therethrough. The first current limiter 21A and the constant-current unit 31 are stopped by the currents If1 and If2 flowing through each of the resistors R3 and R1.

Where, after reaching the maximum value, the output voltage of the rectifier 1 becomes less than the sum of the reference voltages Vf1 and Vf2 (timing t=t4), the second current limiter 21B stops and the first current limiter 21A operates. Even when the second current limiter 21B stops, the second main light source 20B is lit by the current If2 flowing therethrough as a result of discharge of electric energy (charged energy) in the capacitor C3. Where the first current limiter 21A operates, the first main light source 20A is lit by the current If1 under the effect of the input current Iin from the AC power supply 4.

Where the output voltage of the rectifier 1 decreases and becomes less than the reference voltage Vf1 (timing t=t5), the first current limiter 21A stops and the constant-current unit 31 operates. Where the first current limiter 21A stops, electric energy (charged energy) in the capacitor C2 discharges and the current If1 continuously flows through the first main light source 20A. Further, where the constant-current unit 31 operates, the auxiliary light source 30 is lit by the current If3 flowing therethrough under the effect of the input current Iin from the AC power supply 4.

Where the output voltage of the rectifier 1 further drops and becomes less than the reference voltage Vf3 (timing t=t6), the constant-current unit 31 stops. Where the constant-current unit 31 stops, electric energy (charged energy) in the capacitor C1 discharges and the current If1 continuously flows through the first main light source 20A.

Thus, in the illumination device of the present embodiment, the capacitor C3, which is electrically connected in parallel with the second main light source 20B, is made a smoothing capacitor. As a result, light ripples can be reduced by comparison with Embodiment 1 in which the capacitor C3 does not serve for smoothing.

Embodiment 4

Figure 7:
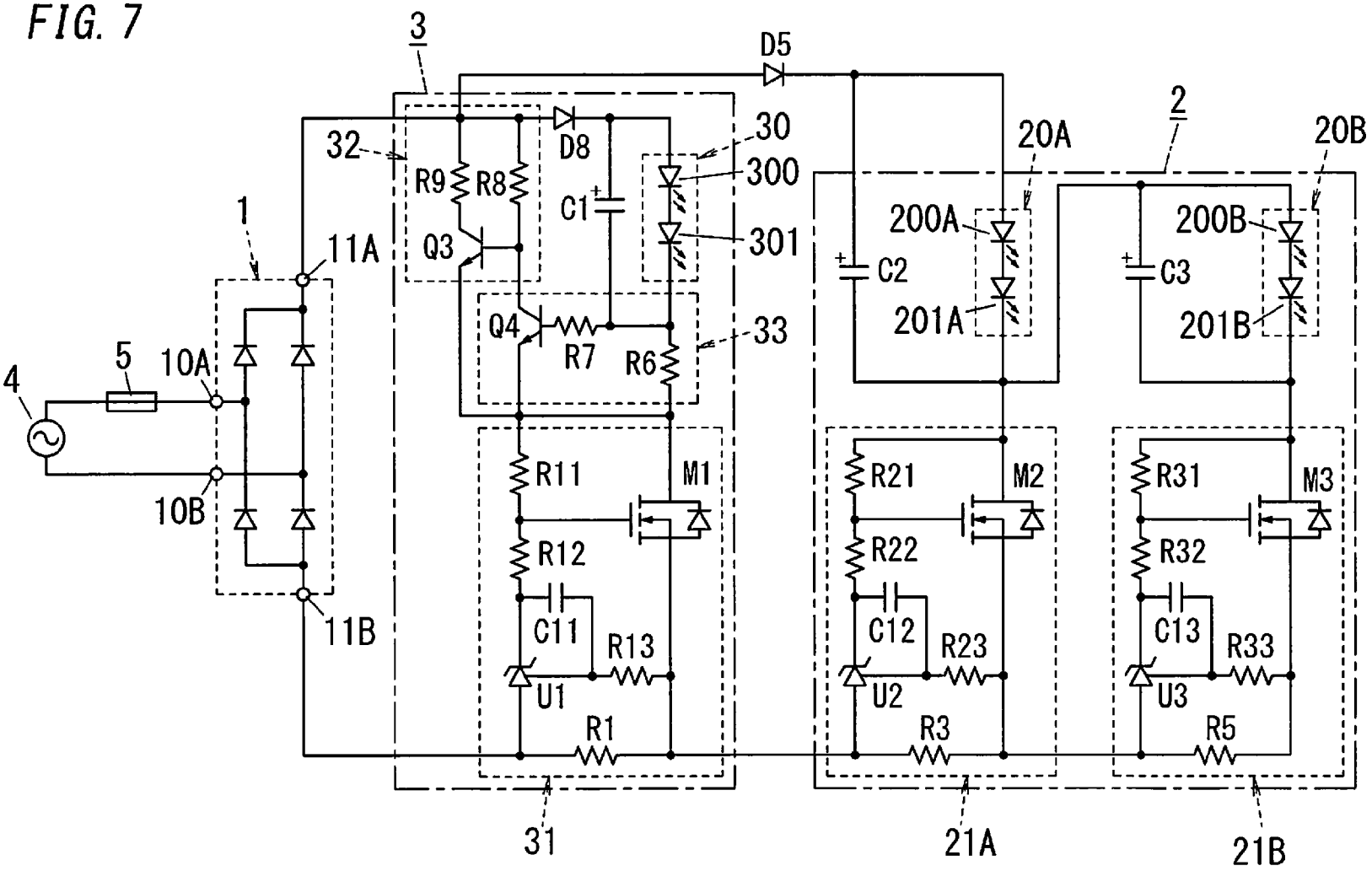
FIG. 7 is a circuit configuration diagram illustrating an illumination device in accordance with Embodiment 4 of the present invention.

An illumination device in accordance with Embodiment 4 of the present invention will be explained with reference to FIGS. 7 and 8. The illumination device of the present embodiment and the illumination device of Embodiment 1 share a basic configuration. Accordingly, constituent elements shared with the illumination device of Embodiment 1 are assigned with the same reference numerals and the explanation thereof is herein omitted.

In the illumination device of the present embodiment, it is preferred that an auxiliary light source block 3 be provided with a current bypass unit 32 and a current bypass controller 33.

The current bypass unit 32 is formed of resistors R8, R9 and a bipolar transistor Q3. The bipolar transistor (referred to hereinafter simply as a "transistor") Q3 is of an NPN type. A collector of the transistor Q3 is electrically connected to a first end of the resistor R9, and an emitter of transistor Q3 is electrically connected with a connection point of a resistor R11 and a transistor M1 (one end of the resistor R11 and a drain of the transistor M1). A base of the transistor Q3 is electrically connected to a first output terminal 11A of the rectifier 1 via the resistor R8. A diode D8 is intervened, with an anode thereof being on the resistor R8 side, between a first end of the resistor R8 electrically connected to the first output terminal 11A and the capacitor C1.

The current bypass controller 33 is formed of resistors R6, R7 and a bipolar transistor Q4. The bipolar transistor (referred to hereinafter simply as a "transistor") Q4 is of an NPN type, and a collector of the transistor Q4 is electrically connected with a base of the transistor Q3 and a second end of the resistor R8. An emitter of the transistor Q4 is electrically connected with the emitter of the transistor Q3 electrically connected to the connection point of the resistor R11 and the transistor M1, and a first end of the resistor R6. A first end of the resistor R7 is electrically connected to a base of the transistor Q4. A second end of the resistor R7 is electrically connected with a negative electrode of the auxiliary light source 30 electrically connected in parallel with a capacitor C1, and a second end of the resistor R6.

The current bypass controller 33 switches off the transistor Q3 of the current bypass unit 32 by switching on the transistor Q4 when the current If3 flows through the resistor R6 and switches on the transistor Q3 by switching off the transistor Q4 when the current If3 does not flow. The current bypass unit 32 is configured to draw in an input current Iin through a constant-current unit 31 when the transistor Q3 is switched on. However, the current bypass controller 33 may be also configured to determine whether or not the current If3 is present from a voltage across an auxiliary light source 30 and switch on/off the transistor Q4 on the basis of the determination. Where the current bypass controller 33 is configured in the above-described manner, the resistor R6 becomes unnecessary and power loss can be reduced.

Next, an operation of the illumination device in the present embodiment will be explained with reference to the circuit configuration diagram depicted in FIG. 7 and a waveform diagram depicted in FIG. 8. The operation explained hereinbelow takes place in one period of the output voltage (pulsating voltage) of a rectifier 1, that is, in half a period of a voltage of an AC power supply 4, and this operation is repeated each period of the pulsating voltage.

Figure 8:
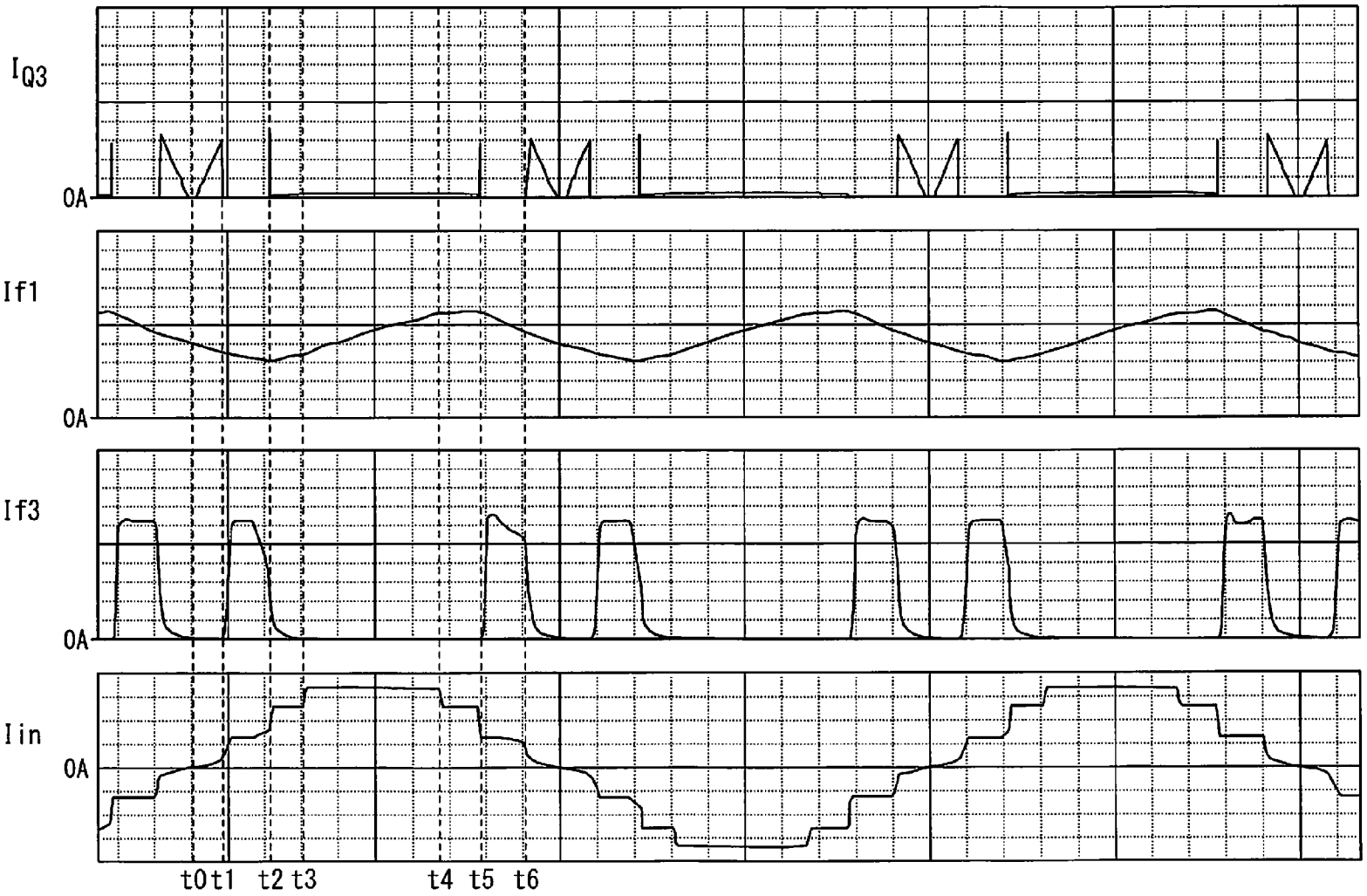
FIG. 8 is a waveform diagram illustrating an operation of Embodiment 4.

In FIG. 8, $I_{Q3}$ denotes a current flowing through the transistor Q3 of the current bypass unit 32, If1 denotes a current flowing through a first main light source 20A, and If3 denotes a current flowing through the auxiliary light source 30. Further, Iin in FIG. 8 stands for an input current flowing from the AC power supply 4 to first and second input terminals 10A, 10B of the rectifier 1.

The timing t=t0 is a zero cross point of the pulsating voltage (voltage of the AC power supply 4), and the output voltage (pulsating voltage) of the rectifier 1 at this timing is 0 V. In the vicinity of the zero cross point, the pulsating voltage is lower than a reference voltage Vf3 (=50 V) of the auxiliary light source 30, and therefore the input current Iin from the AC power supply 4 is 0 A. At this time, a slight current If3 caused by discharge of electric energy (charged energy) in the capacitor C1 flows through the auxiliary light source 30, but no current flows through the resistor R6. Therefore, the transistor Q4 of the current bypass controller 33 is switched off, and the transistor Q3 of the current bypass unit 32 is switched on. Where the transistor Q3 is switched on, an input current Iin (IQ3) is drawn in through the resistor R9 and the transistor Q3.

Where the output voltage of the rectifier 1 rises and exceeds the reference voltage Vf3 (timing t=t1), the constant-current unit 31 operates and the auxiliary light source 30 is lit by the current If3 flowing therethrough. Further, the transistor Q4 of the current bypass controller 33 is switched on and the transistor Q3 of the current bypass unit 32 is switched off by the current If3 flowing through the resistor R6. In other words, since the input current Iin does not flow through the resistor R9, the loss on the resistor R9 is eliminated.

Where the output voltage of the rectifier 1 rises and exceeds a reference voltage Vf1 (=100 V) (timing t=t2), a first current limiter 21A operates and the first main light source 20A is lit by the current If1 flowing therethrough. The constant-current unit 31 is stopped by currents If3 and If1 flowing through the resistor R1. However, the auxiliary light source 30 is lit by the current If3 flowing therethrough while electric energy (charged energy) in the capacitor C1 discharges.

Where the output voltage of the rectifier 1 rises and exceeds the sum total of reference voltages Vf1 and Vf2 (=120 V) (timing t=t3), a second current limiter 21B operates and the first main light source 20A and the second main light source 20B are lit by the currents If1 and If2 flowing therethrough. The first current limiter 21A and the constant-current unit 31 are stopped by the currents If1 and If2 flowing through each of the resistors R3 and R1.

Where, after reaching the maximum value, the output voltage of the rectifier 1 becomes less than the sum of the reference voltages Vf1 and Vf2 (timing t=t4), the second current limiter 21B stops and the first current limiter 21A operates. Even when the second current limiter 21B stops, the second main light source 20B is lit by the current If2 flowing therethrough as a result of discharge of electric energy (charged energy) in the capacitor C3. Where the first current limiter 21A operates, the current If1 flows through the first main light source 20A and the first main light source 20A is lit under the effect of the input current Iin from the AC power supply 4.

Where the output voltage of the rectifier 1 decreases and becomes less than the reference voltage Vf1 (timing t=t5), the first current limiter 21A stops and the constant-current unit 31 operates. Where the first current limiter 21A stops, electric energy (charged energy) in the capacitor C2 discharges and the current If1 continuously flows through the first main light source 20A. Further, where the constant-current unit 31 operates, the current If3 flows through the auxiliary light source 30 and the auxiliary light source 30 is lit under the effect of the input current Iin from the AC power supply 4.

Where the output voltage of the rectifier 1 further drops and becomes less than the reference voltage Vf3 (timing t=t6), the constant-current unit 31 stops. Where the constant-current unit 31 stops, electric energy (charged energy) in the capacitor C1 discharges and the current If1 continuously flows through the first main light source 20A. Further, when the constant-current unit 31 stops, no current flows through the resistor R6. As a result, the transistor Q4 of the current bypass controller 33 is switched off and the transistor Q3 of the current bypass unit 32 is switched on. As a result, of the transistor Q3 being switched on, the input current Iin (IQ3) is drawn in through the resistor R9 and the transistor Q3.

Thus, when the pulsating voltage (voltage of the AC power supply 4) of the rectifier 1 is less than the reference voltage Vf3, the current bypass unit 32 draws in the input current Iin. As a result, the illumination device of the present embodiment makes it possible to reduce input current distortions by comparison with the illumination device of Embodiment 1. Further, in the illumination device of the present embodiment, since the current bypass controller 33 stops the current bypass unit 32 when the pulsating voltage of the rectifier 1 is equal to or higher than the reference voltage Vf3, the unnecessary power consumption at the time the main light source block 2 or the auxiliary light source block 3 is lit can be suppressed. Further, when a wall switch equipped with a position display lamp is connected or when a dimmer of a phase control system is connected, the auxiliary light source block 3 can be prevented from being lit at a very low intensity by the flow of a very small current.

Further, as mentioned hereinabove, in the illumination device of the present embodiment, it is preferred that the auxiliary light source block 3 have a bleeder (current bypass unit 32 and current bypass control unit 33) that allows a current to flow between first and second output terminals 11A, 11B of the rectifier 1 within a period of time in which no current flows through the auxiliary light source 30. The bleeder (current bypass unit 32 and current bypass control unit 33) is preferably configured not to allow the current to flow within a period of time in which a current flows through the auxiliary light source 30. Where the illumination device of the present embodiment is configured in the above-described manner the input current distortions can be reduced while suppressing the increase in power consumption.

Embodiment 5

An illumination device in accordance with Embodiment 5 of the present invention will be explained with reference to FIGS. 9 and 10. The illumination device of the present embodiment and the illumination device of Embodiment 3 share a basic configuration. Accordingly, constituent elements shared with the illumination device of Embodiment 3 are assigned with the same reference numerals and the explanation thereof is herein omitted.

A specific feature of the present embodiment is that the illumination device is provided with a suppressor 22 that suppresses peaks of currents respectively flowing through a main light source block 2 and an auxiliary light source block 3. For example, where a voltage of an AC power supply 4 is increased by 10% and a maximum value (peak value) of a pulsating voltage rises to $110\,V\times\sqrt{2}\approx156\,V$, a period of time in which a current flows through the main light source block 2 and the auxiliary light source block 3 increases and the quantity of light also increases.

In the illumination device of the present embodiment, as a result of suppressing the current flowing through the main light source block 2 and the auxiliary light source block 3 with the suppressor 22, it is possible to suppress the increase in quantity of light which follows the increase in the voltage of the AC power supply 4.

Figure 9:
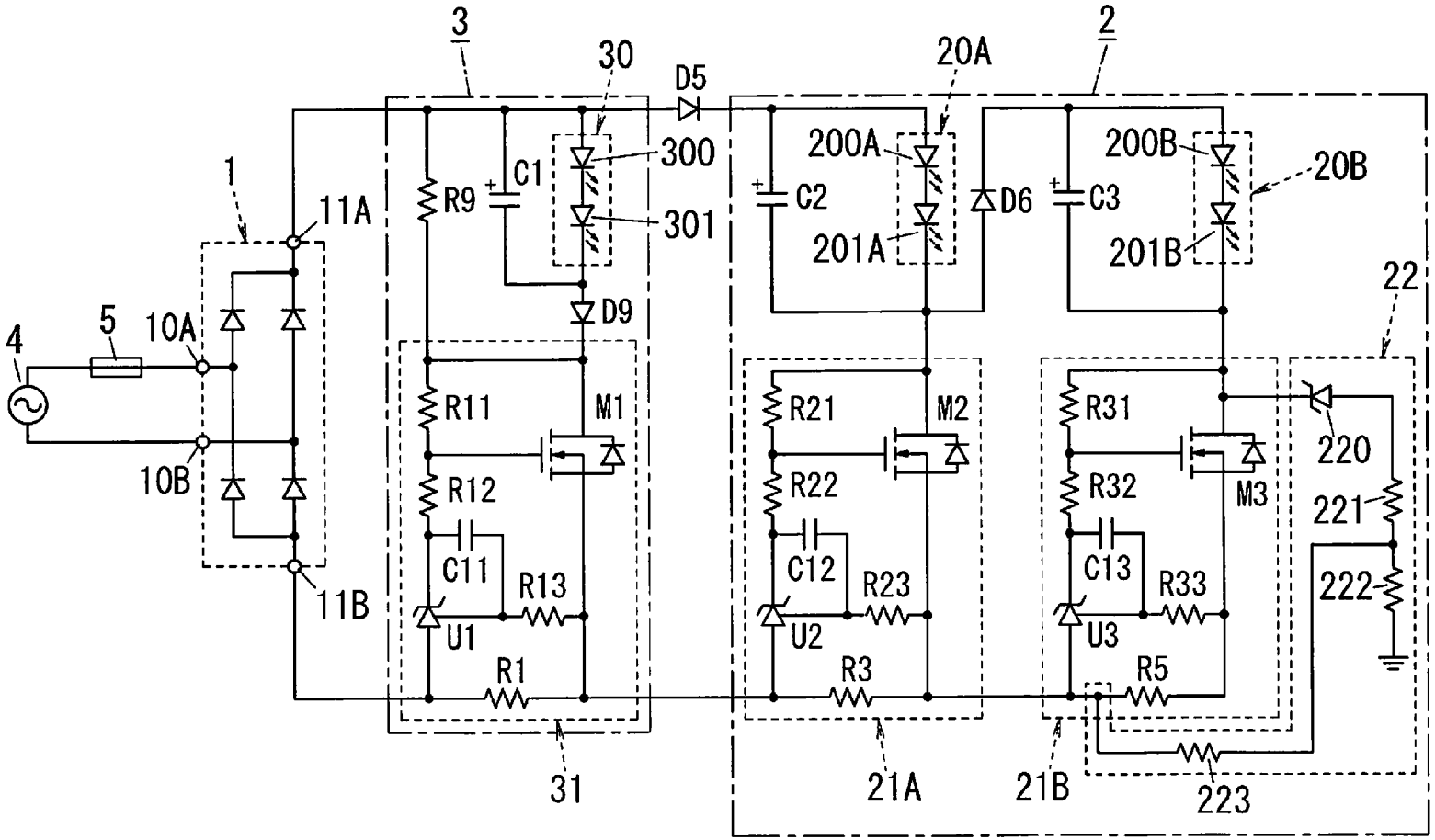
FIG. 9 is a circuit configuration diagram illustrating an illumination device in accordance with Embodiment 5 of the present invention.

As depicted in FIG. 9, the suppressor 22 is formed of a Zener diode 220 and three resistors 221 to 223. A cathode of the Zener diode 220 is electrically connected to a drain of a transistor M3 of a second current limiter 21B, and an anode of the Zener diode 220 is electrically connected to a first end of the resistor 221. The two resistors 221, 222 are electrically connected in series between the anode of the Zener diode 220 and the ground. The resistor 223 is electrically connected with a connection point of the two resistors 221, 222 and an anode of a shunt regulator U3 of the second current limiter 21B.

Figure 10:
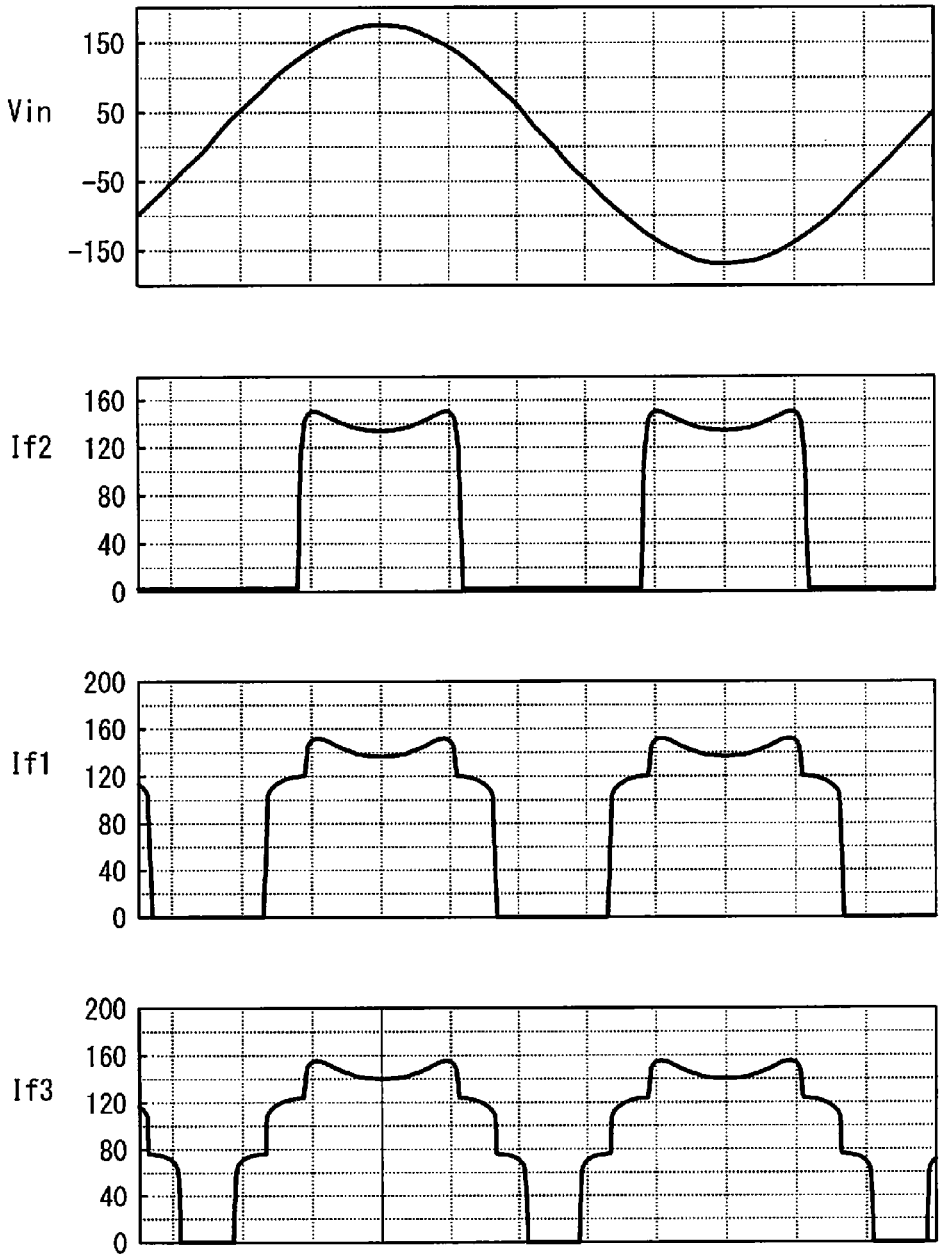
FIG. 10 is a waveform diagram illustrating an operation of Embodiment 5.

In FIG. 10, Vin denotes a voltage of an AC power supply 4, If3 denotes a current flowing through an auxiliary light source 30, If1 denotes a current flowing through a first main light source 20A, and If2 denotes a current flowing through a second main light source 20B.

Where the voltage of the AC power supply 4 rises and a drain voltage (electric potential of the drain with respect to the ground; same hereinbelow) of a transistor M3 of the second current limiter 21B exceeds a Zener voltage of the Zener diode 220, the Zener diode 220 is conductive. As a result of the Zener diode 220 being conductive, the suppressor 22 rises a voltage on a resistor R5 of the second current limiter 21B.

Where the voltage on the resistor R5 is raised by the suppressor 22, the shunt regulator U3 of the second current limiter 21B decreases the output current. In this case, not only the current If2 of the second main light source 20B, but also the current If1 of the first main light source 20A and the current If3 of the auxiliary light source 30 flow together in the second current limiter 21B. Therefore, where the shunt regulator U3 decreases the output current, the currents If1, If2, If3 are all reduced, as depicted in FIG. 10.

As described hereinabove, the illumination device of the present embodiment is preferably provided with the suppressor 22 that suppresses the peaks of currents respectively flowing through the main light source block 2 and the auxiliary light source block 3. Since the peaks of currents respectively flowing through the main light source block 2 and the auxiliary light source block 3 are suppressed by the suppressor 22, the illumination device of the present embodiment makes it possible to suppress the increase in quantity of light following the rise in the voltage of the AC power supply 4.

Figure 11:
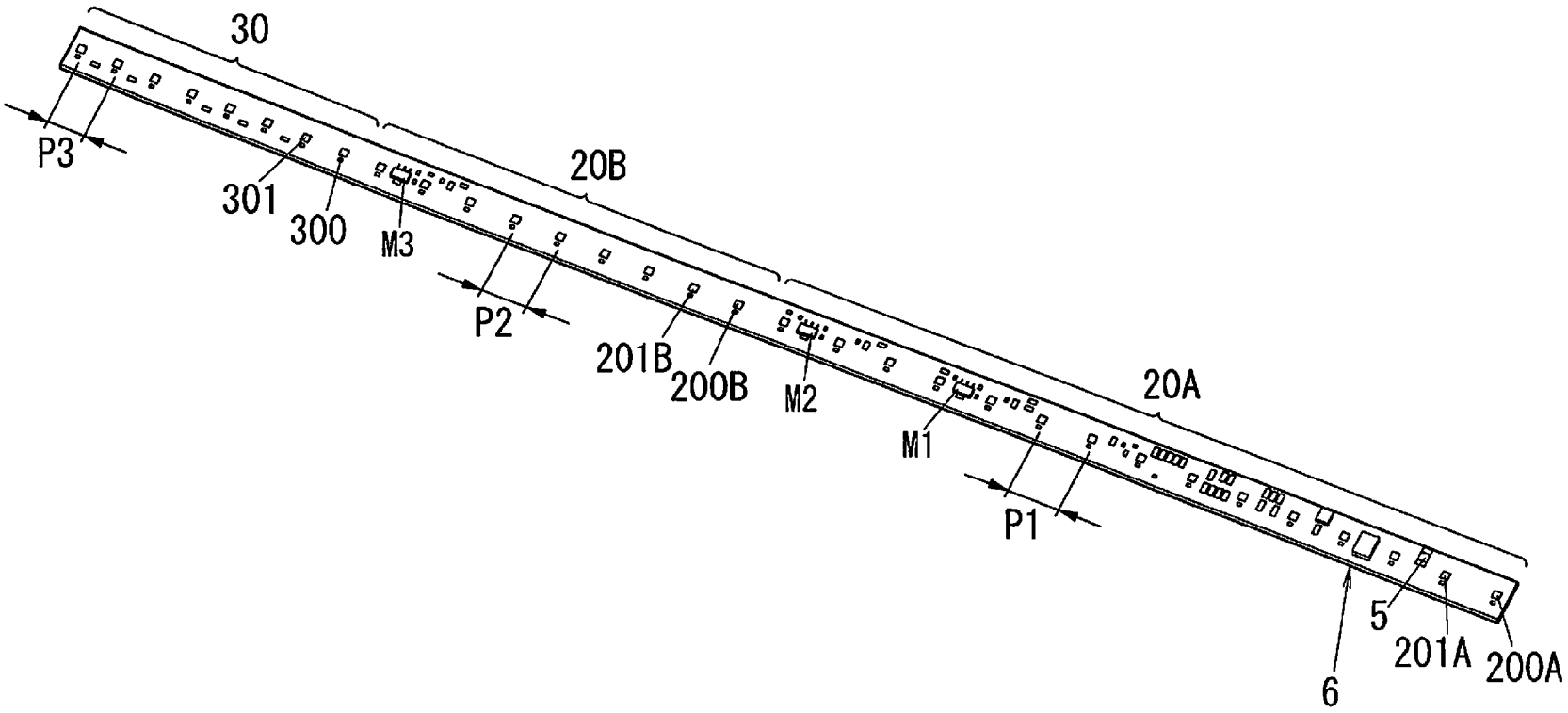
FIG. 11 is an external perspective view of an illumination device in each embodiment.

In the illumination devices of Embodiments 1 to 5, as depicted in FIG. 11, the rectifier 1, the main light source block 2, and the auxiliary light source block 3 may be mounted on one mounting substrate 6. The mounting substrate 6 is preferably formed in an elongated rectangular flat-plate shape by using a glass fabric/non-woven glass fabric-based epoxy resin copper clad laminate.

In the illumination devices of Embodiments 1 to 5, the current of the first main light source 20A which is lit at the highest reference voltage Vf1 is the largest, and the current of the auxiliary light source 30 which is lit at the lowest reference voltage Vf3 is the smallest. Further, the current of the second main light source 20B which is electrically connected in parallel with the first current limiter 21A is the second largest. Where the LEDs 200A, 201A, . . . of the light sources 20A, 20B, 30 are all constituted by identical light-emitting diodes, the quantity of light increases in the increasing order of currents in LEDs 200A, 201A, . . . .

Accordingly, in the illumination device of the present embodiment, it is preferred that the LED arrays (first main light source 20A, second main light source 20B, auxiliary light source 30) be mounted on the mounting substrate 6 such that a spacing between the light-emitting diodes 200A, 201A, . . . increases as a current flowing therethrough increases.

For example, the spacing between two or more LEDs 200A, 201A, . . . constituting the first main light source 20A is denoted by P1, the spacing between two or more LEDs 200B, 201B, . . . constituting the second main light source 20B is denoted by P2, and the spacing between two or more LEDs 300, 301, . . . constituting the auxiliary light source 30 is denoted by P3 (here, P3<P2<P1).

The first main light source 20A is mounted at a first end side (right side in FIG. 11), in the longitudinal direction, of the mounting substrate 6 with the largest spacing P1. The second main light source 20B is mounted in the center, in the longitudinal direction, of the mounting substrate 6 with the spacing P2. The auxiliary light source 30 is mounted at a second end side (left side in FIG. 11), in the longitudinal direction, of the mounting substrate 6 with the smallest spacing P3. It is preferred that the rectifier 1, the fuse 5 and the like be mounted on a site with the largest spacing P1 of the LEDs 200A, 201A, . . . , that is, on the right side, in the longitudinal direction, of the mounting substrate 6.

As indicated hereinabove, it is preferred that the mounting substrate 6 on which the LED arrays are mounted be provided in the illumination device of the present embodiment. The LED arrays are preferably mounted on the mounting substrate 6 such that the spacing P1 to P3 between the light-emitting diodes 200A, 201A, . . . increases as the current flowing therethrough increases.

Where the illumination device of the present embodiment is configured in the above-described manner, light unevenness in the illumination device as a whole can be suppressed. Another merit is that where electronic components (rectifier 1, transistors M1 to M3, and the like) other than the LED arrays are coated with a white coating material, the absorption of light by the black resin packages of the electronic components is suppressed and the light take-out efficiency is improved. Where portions of the mounting substrate 6 outside the LED arrays are coated with a flame-resistant synthetic resin with a high reflectance, safety can be improved.

Embodiment 6

Figure 12:
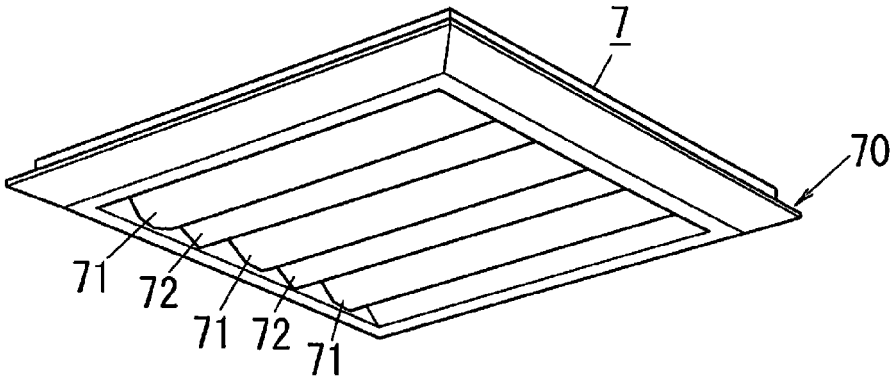
FIG. 12 is a perspective view illustrating an illumination fixture in accordance with Embodiment 6 of the present invention.

An illumination fixture in accordance with an embodiment of the present invention will be explained in detail with reference to FIG. 12. The illumination fixture 7 of the present embodiment is preferably constituted by a rectangular fixture main body 70 which is to be directly attached to a ceiling, three light source units 71, and two reflecting plates 72.

Each light source unit 71 has, for example, an illumination device with the structure depicted in FIG. 11, a holding member that holds the mounting substrate 6, and a cover that covers the holding member together with the mounting substrate 6. The light source units 71 are attached side by side with a spacing therebetween to a lower surface of the fixture main body 70.

The reflection plate 72 is configured by bending in two a flat rectangular metal plate along the longitudinal direction thereof and attached to the lower surface of the fixture main body 70 such as to be disposed between the adjacent light source units 71.

As indicated hereinabove, the illumination fixture 7 of the present embodiment is provided with the illumination device (light source units 71) and the fixture main body 70 that holds the illumination device. However, an illumination fixture in accordance with the present invention is not limited to the illumination fixture 7 of the present embodiment and may have another structure.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. An illumination device comprising:

a rectifier configured to rectify a sine wave AC voltage and output a pulsating voltage from first and second output terminals;

a main light source block comprising a plurality of main light sources which is electrically connected in series between the first and second output terminals and each of which has an LED array in which a plurality of light-emitting diodes is electrically connected in series, and a plurality of current limiters which is individually and electrically connected in series with the plurality of main light sources so as to respectively intervene between the plurality of main light sources and one of the first and second output terminals, the plurality of current limiters being configured to respectively limit currents flowing through the plurality of main light sources; and an auxiliary light source block comprising an auxiliary light source having an LED array in which a plurality of light-emitting diodes is electrically connected in series, and a constant-current unit configured to adjust a current flowing through the LED array of the auxiliary light source to a constant current, a series circuit of the auxiliary light source and the constant-current unit being electrically connected in parallel with the main light source block, between the first and second output terminals of the rectifier, wherein a smoothing capacitor is electrically connected in parallel with a specific main light source among the plurality of main light sources, the specific main light source and a corresponding current limiter being electrically connected in parallel with the series circuit of the auxiliary light source and the constant-current unit.

2. The illumination device of claim 1, wherein the LED array of the auxiliary light source is configured as part of the LED array of the specific main light source.

3. The illumination device of claim 2, further comprising a suppressor configured to suppress peaks of currents respectively flowing through the main light source block and the auxiliary light source block.

4. The illumination device of claim 3, wherein the auxiliary light source block has a bleeder that allows a current to flow between the first and second output terminals of the rectifier within a period of time in which no current flows through the auxiliary light source, the bleeder being configured not to allow the current to flow within a period of time in which the current flows through the auxiliary light source.

5. The illumination device of claim 4, further comprising a mounting substrate on which the LED arrays of the main light source block and the auxiliary light source block are mounted, the LED arrays being mounted on the mounting substrate such that a spacing between light-emitting diodes of each LED array increases as a current flowing therethrough increases.

6. The illumination device of claim 3, further comprising a mounting substrate on which the LED arrays of the main light source block and the auxiliary light source block are mounted, the LED arrays being mounted on the mounting substrate such that a spacing between light-emitting diodes of each LED array increases as a current flowing therethrough increases.

7. The illumination device of claim 2, wherein the auxiliary light source block has a bleeder that allows a current to flow between the first and second output terminals of the rectifier within a period of time in which no current flows through the auxiliary light source, the bleeder being configured not to allow the current to flow within a period of time in which the current flows through the auxiliary light source.

8. The illumination device of claim 7, further comprising a mounting substrate on which the LED arrays of the main light source block and the auxiliary light source block are mounted, the LED arrays being mounted on the mounting substrate such that a spacing between light-emitting diodes of each LED array increases as a current flowing therethrough increases.

9. The illumination device of claim 2, further comprising a mounting substrate on which the LED arrays of the main light source block and the auxiliary light source block are mounted, the LED arrays being mounted on the mounting substrate such that a spacing between light-emitting diodes of each LED array increases as a current flowing therethrough increases.

10. An illumination fixture comprising:

the illumination device of claim 2; and a fixture main body holding the illumination device.

11. The illumination device of claim 1, further comprising a suppressor configured to suppress peaks of currents respectively flowing through the main light source block and the auxiliary light source block.

12. The illumination device of claim 11, wherein the auxiliary light source block has a bleeder that allows a current to flow between the first and second output terminals of the rectifier within a period of time in which no current flows through the auxiliary light source, the bleeder being configured not to allow the current to flow within a period of time in which the current flows through the auxiliary light source.

13. The illumination device of claim 12, further comprising a mounting substrate on which the LED arrays of the main light source block and the auxiliary light source block are mounted, the LED arrays being mounted on the mounting substrate such that a spacing between light-emitting diodes of each LED array increases as a current flowing therethrough increases.

14. The illumination device of claim 11, further comprising a mounting substrate on which the LED arrays of the main light source block and the auxiliary light source block are mounted, the LED arrays being mounted on the mounting substrate such that a spacing between light-emitting diodes of each LED array increases as a current flowing therethrough increases.

15. The illumination device of claim 1, wherein the auxiliary light source block has a bleeder that allows a current to flow between the first and second output terminals of the rectifier within a period of time in which no current flows through the auxiliary light source, the bleeder being configured not to allow the current to flow within a period of time in which the current flows through the auxiliary light source.

16. The illumination device of claim 15, further comprising a mounting substrate on which the LED arrays of the main light source block and the auxiliary light source block are mounted, the LED arrays being mounted on the mounting substrate such that a spacing between light-emitting diodes of each LED array increases as a current flowing therethrough increases.

17. The illumination device of claim 1, further comprising a mounting substrate on which the LED arrays of the main light source block and the auxiliary light source block are mounted, the LED arrays being mounted on the mounting substrate such that a spacing between light-emitting diodes of each LED array increases as a current flowing therethrough increases.

18. An illumination fixture comprising:

the illumination device of claim 1; and a fixture main body holding the illumination device.

* * * * *